US005804320A

United States Patent [19]

Tomioka et al.

[11] Patent Number: 5,804,320

[45] **Date of Patent: *Sep. 8, 1998**

[54] RECORDING MEDIUM

[75] Inventors: Hiroshi Tomioka, Matsudo; Kyo Miura, Yokohama; Hitoshi Yoshino, Zama; Yuji Kondo, Machida, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 549,204

[22] Filed: Oct. 27, 1995

[30] Foreign Application Priority Data

| | | | |
|---|---|---|---|
| Oct. 31, 1994 | [JP] | Japan | 6-266592 |
| Sep. 26, 1995 | [JP] | Japan | 7-247342 |
| Oct. 20, 1995 | [JP] | Japan | 7-272861 |

[51] Int. Cl.[6] ..... B41M 5/00

[52] U.S. Cl. ..... 428/478.2; 428/195; 428/478.8

[58] Field of Search ..... 428/478.2, 478.8, 428/195, 537.5

[56] References Cited

U.S. PATENT DOCUMENTS

| | | | |
|---|---|---|---|
| 2,761,791 | 9/1956 | Russel | 117/34 |
| 2,983,611 | 5/1961 | Allen et al. . | |
| 3,017,280 | 1/1962 | Yudelson et al. . | |
| 3,100,704 | 8/1963 | Coles et al. . | |
| 4,001,024 | 1/1977 | Dittman et al. | 96/87 R |
| 4,202,870 | 5/1980 | Weber et al. | 423/630 |
| 4,242,271 | 12/1980 | Weber et al. | 260/448 |
| 4,379,804 | 4/1983 | Eisele et al. | 428/332 |
| 4,474,847 | 10/1984 | Schroder et al. | 428/323 |
| 4,649,064 | 3/1987 | Jones | 428/195 |
| 4,879,166 | 11/1989 | Misuda et al. | 428/212 |
| 5,104,730 | 4/1992 | Misuda et al. | 428/304.4 |

(List continued on next page.)

FOREIGN PATENT DOCUMENTS

| | | | |
|---|---|---|---|
| 445327 | 9/1991 | European Pat. Off. . | |
| 0500021 | 8/1992 | European Pat. Off. . | |
| 636489 | 2/1995 | European Pat. Off. . | |
| 3024205 | 1/1982 | Germany . | |
| 52-53012 | 4/1977 | Japan | 428/195 |
| 53-49113 | 5/1978 | Japan | 428/195 |
| 54-059936 | 5/1979 | Japan . | |
| 55-05830 | 1/1980 | Japan | 428/195 |
| 55-051583 | 4/1980 | Japan . | |
| 55-146786 | 11/1980 | Japan . | |

(List continued on next page.)

OTHER PUBLICATIONS

Takashi Ohno, "The Relationship between Molecular Weight Distribution and Viscosity of Gelatin and Jelly Strength", Nippon Shasin Gakkai (Japan Photographic Society), (Mar. 9, 1984) in Japanese, with English Translation.

S. Brunauer, The Journal of the American Chemical Society, vol. LX, (1938) pp. 309–319.

J. McBain, The Journal of the American Chemical Society, vol. LVII, (1935) pp. 699–700.

(List continued on next page.)

*Primary Examiner*—Pamela R. Schwartz

*Attorney, Agent, or Firm*—Fitzpatrick, Cella, Harper & Scinto

[57] ABSTRACT

A recording medium comprises an ink-receiving layer comprising a pigment and an alkali-process gelatin, wherein the alkali-process gelatin has no sol-gel reversibility in an environment of room temperature and has a weight average molecular weight within the range of from 50,000 to 150,000. A coating aqueous dispersion comprises water and has dispersed therein a pigment and the alkali-process gelatin. A process for producing a recording medium comprises the steps of coating on a support at room temperature the coating aqueous dispersion and drying the resulting coating at a high temperature of 80° C. or above. An image forming method comprises ejecting minute droplets of an ink from fine orifices to apply the ink droplets to the recording medium to make a print. A printed material comprises the recording medium.

27 Claims, 1 Drawing Sheet

U.S. PATENT DOCUMENTS

| | | | |
|---|---|---|---|
| 5,141,599 | 8/1992 | Jahn et al. | 162/137 |
| 5,188,931 | 2/1993 | Marinelli et al. | 430/539 |
| 5,189,007 | 2/1993 | Aihara et al. | 503/207 |
| 5,372,884 | 12/1994 | Abe et al. | 428/331 |

FOREIGN PATENT DOCUMENTS

| | | | |
|---|---|---|---|
| 2-276670 | 11/1990 | Japan | 428/195 |
| 2-289375 | 11/1990 | Japan . | |
| 3-72460 | 3/1991 | Japan . | |
| 3-72460 | 11/1991 | Japan | 428/195 |
| 4-037576 | 2/1992 | Japan . | |
| 4-37576 | 2/1992 | Japan | 428/195 |
| 4-67985 | 3/1992 | Japan | 428/195 |
| 4-67986 | 3/1992 | Japan . | |
| 5-016517 | 1/1993 | Japan . | |
| 5-032037 | 2/1993 | Japan . | |
| 5-16015 | 3/1993 | Japan . | |
| 5-125437 | 5/1993 | Japan . | |
| 5-125438 | 5/1993 | Japan . | |
| 5-125439 | 5/1993 | Japan . | |
| 6-064306 | 3/1994 | Japan . | |
| 6-114571 | 4/1994 | Japan . | |
| 7-232475 | 9/1995 | Japan . | |
| WO 94 20303 | 9/1994 | WIPO . | |

OTHER PUBLICATIONS

E. Barrett, et al., The Journal of the American Chemical Society, vol. LXXIII, (1951) pp. 373–380.

J. Rocek, et al., Applied Catalysis, vol. 74 (1991) pp. 29–36.

J. Rocek, et al., Collect. Czech. Chem. Commun., vol. 56 (1991) pp. 1253–1262.

J. Menezo, et al., React. Kinet. Catal. Lett., vol. 46, No. 1, (1992) pp. 1–6.

Derwent Association, No.86–004825 with respect to JP–A–60–232990.

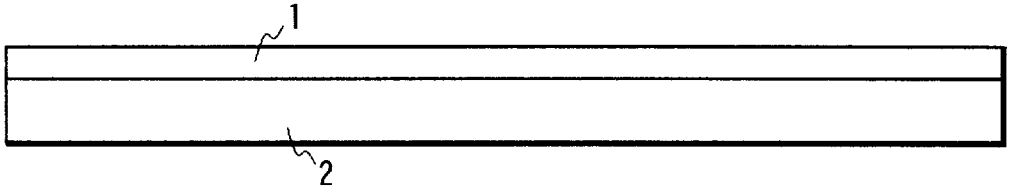
1
2

RECORDING MEDIUM

BACKGROUND OF THE INVENTION

1. Field of the Invention

This invention relates to a recording medium suited for recording carried out using a water-based ink, an image forming method making use of the medium, an aqueous dispersion for the medium and a process for producing the medium. More particularly, it relates to a recording medium that can achieve high image density and resolution, can provide sharp color tone, has superior ink absorptivity, may cause no change in color tone of images, and has a good color tone reproducibility, an image forming method that carries out an ink-jet recording process by the use of the medium, and a printed material thereby obtained. This invention also relates to an aqueous dispersion suited for producing such a recording medium, and a process for producing the recording medium by the use of the aqueous dispersion.

2. Related Background Art

In recent years, ink-jet recording, which is a system used to record images, characters, letters, and so forth, by causing minute ink droplets to be ejected, utilizing various types of drive mechanisms, and to adhere to a recording medium such as paper, has rapidly spread in various uses, including information machinery as apparatus for recording various types of images, because of the features that the recording can be performed at high speed and low noise, multi-color recording can be achieved with ease, recording patterns can have great flexibility, and neither development nor fixing is required.

The ink-jet recording is also being widely put in practical use in the field of full-color image recording, because images formed by multi-color ink-jet recording can be recorded as images comparable to multi-color prints obtained by lithography or prints formed by color photography, and at a lower cost than those obtained by conventional multi-color printing or color photography, when a small number of printed materials are prepared.

Recording apparatus and recording processes have been improved by progress in recording performances, e.g., with achievement of higher recording speed, higher minuteness and full-color recording. With regard to recording mediums also, it has become required for them to have high-level properties.

To meet such requirements, forms of recording mediums have been hitherto proposed in great variety. For example, Japanese Patent Application Laid-open No. 55-5830 discloses an ink-jet recording paper provided on the surface of its support with an ink-absorptive coat layer. Japanese Patent Application Laid-open No. 55-51583 discloses an example in which non-amorphous silica is used as a pigment in a coating layer; and also Japanese Patent Application Laid-open No. 55-146786, an example in which a water-soluble polymer coat layer is used.

Especially, Japanese Patent Application Laid-open No. 5-16517, Japanese Patent Publication No. 3-72460, Japanese Patent Applications Laid-open No. 2-289375 and No. 6-64306 and U.S. Pat. No. 4,379,804 disclose methods in which gelatin is used in ink-receiving layers of ink-jet recording sheets. From these, it has become clear that gelatin has an advantageous function for the absorption of ink solvents.

In recent years, a recording medium having a coat layer formed using an alumina hydrate of Boehmite structure is proposed, as disclosed in, e.g., U.S. Pat. No. 4,879,166 and No. 5,104,730 and Japanese Patent Applications Laid-open No. 2-276670, No. 4-37576 and No. 5-32037.

The above techniques known in the art, however, have the followings problems.

(1) In general, when gelatin with a high-molecular weight is used as a binder, an aqueous dispersion thereof coagulates at room temperature to form a gel, and hence, when coated, the aqueous dispersion must be heated to 40° C. to 60° C. This affects the equipment of dispersion devices and the productivity.

Japanese Patent Application Laid-open No. 6-64306 discloses a cold dry method, in which at the time of coating, a coating layer is caused to gel at a temperature lower than the gelling temperature, and thereafter the coating is gradually dried at the temperature lower than the gelling temperature. This method, however, takes a long time for drying and greatly affects the equipment of coating devices and the productivity. Also, since the gelatin is sol-gel reversible at room temperature, the dispersion containing gelatin must be heated when coated, as stated above, and hence hydrolysis proceeds under application of heat to make the gelatin low-molecular weight. This causes a problem in that the aqueous dispersion turns low-viscosity, making it necessary to store the aqueous dispersion under refrigeration.

Moreover, when the low-molecular weight gelatin is used, it has no gel-forming ability (ability to form a gel) at room temperature, and hence it becomes unnecessary to apply heat in the course of dispersion or coating. Since, however, the gelatin has a low-molecular weight, the aqueous dispersion has poor film forming properties and thixotropic properties to cause the phenomenon of sagging at the time of coating or to tend to cause cracks. Hence, it becomes difficult to stably obtain a thick ink-receiving layer.

(2) When an alumina hydrate is used as a pigment in the recording medium, it becomes difficult to coat the aqueous dispersion because of an increase in its viscosity with time, bringing about the problem that the aqueous dispersion can not be made to have a high solid matter concentration.

Japanese Patent Application Laid-open No. 4-67986 discloses a method of decreasing the degree of polymerization of binder polymers. However, there are the problems that the ink-receiving layer causes defects such as cracks or a decrease in water resistance, and no satisfactory improvements have been made.

(3) As a proposal to improve ink absorptivity and image resolution, U.S. Pat. No. 5,104,730, Japanese Patent Publication No. 3-72460, Japanese Patent Application Laid-open No. 4-37576, etc. disclose methods in which the ink-receiving layer is formed in double-layer or multi-layer construction. In such methods, the coating and drying of ink-receiving layers must be carried out twice or more, so that the number of steps increases, greatly affecting the productivity, and also differences in physical properties of the respective layers may cause changes over time, defects such as cracks of the ink-receiving layers, and also the problem that the layers separate and come off during printing.

SUMMARY OF THE INVENTION

Accordingly, an object of the present invention is to provide a recording medium that can achieve high image density and resolution, can provide a sharp color tone, has a superior ink absorptivity, may cause no change in color tone of images, and has a good color tone reproducibility; an ink-jet recording process making use of the medium; an aqueous dispersion suited for producing such a recording medium, in particular, having superior coating suitability and also superior productivity and stability over time or storage stability; and a process for producing the recording medium by the use of the aqueous dispersion.

The present invention provides a recording medium comprising an ink-receiving layer comprising a pigment and an alkali-process gelatin, wherein the alkali-process gelatin has no sol-gel reversibility at room temperature and has a weight average molecular weight within the range of 50,000 to 150,000.

The present invention also provides a coating aqueous dispersion comprising water and dispersed therein a pigment and an alkali-process gelatin, wherein the alkali-process gelatin has no sol-gel reversibility at room temperature and has a weight average molecular weight within the range of from 50,000 to 150,000.

The present invention still also provides a process for producing a recording medium, comprising the steps of;

coating on a support at room temperature a coating aqueous dispersion comprising water and dispersed therein a pigment and an alkali-process gelatin that has no sol-gel reversibility at room temperature and has a weight average molecular weight within the range of 50,000 to 150,000; and drying the resulting coating at a high temperature of 80° C. or above.

The present invention further provides an image forming method comprising ejecting minute droplets of an ink from fine orifices to apply the ink droplets to a recording medium to make a print, wherein the recording medium comprises the recording medium described above.

The present invention still further provides a printed material comprising the recording medium described above and an image formed thereon.

BRIEF DESCRIPTION OF THE DRAWING

The figure is a cross section to illustrate an embodiment of the recording medium of the present invention.

DESCRIPTION OF THE PREFERRED EMBODIMENTS

As a result of extensive studies, the present inventors have employed a pigment and, as a binder, a specific alkali-process gelatin that is a high-molecular weight material and has no sol-gel reversibility (setting properties) at room temperature, and thus have solved the problems discussed above.

Herein, the room temperature refers to a temperature ranging from 15° C. to 30° C.

The alkali-process gelatin used in the present invention is a natural product and a polymeric electrolyte having amino groups and carboxyl groups. Hence, it has superior features in ink absorptivity, resolution, color reproducibility, image density and so forth, compared with other polymers. In addition, compared with synthetic resins, gelatin has a broad molecular weight distribution inherent in natural products, and has high dispersibility and thixotropic properties together with film forming properties and flexibility. Hence, it can stably form a crack-free, thick, ink-receiving layer. As the result, a recording medium having sufficient ink absorptivity and image (print) suitability such as resolution and satisfying appearance suitability such as high glossiness can be obtained.

The present invention also makes it possible to prepare and coat an aqueous dispersion at room temperature, which has been hitherto difficult when a gelatin having setting properties is used. At the same time, it brings about improvements in the productivity of aqueous dispersions and in stability to changes over time, or storage stability. The recording medium produced using this gelatin, compared with those produced using the conventional gelatin having setting properties, can be dried at a high temperature, and hence has lower water content after drying, has superior ink absorption speed, and can form sharp images with less feathering.

The recording medium of the present invention has the structure as shown in the Figure, which comprises a base material 2 (a support) and formed thereon an ink-receiving layer 1, mainly composed of a pigment and a binder.

The alkali-process gelatin preferably used in the present invention will be described below. The alkali-process gelatin used in the present invention is an alkali-process gelatin (alkali-treated gelatin) having been subjected to treatment with a lime solution in the process of its production from collagen (ossein), subjected to the step of deliming, using pig skin, beef bone and so forth as raw materials.

The alkali-process gelatin used in the present invention can be obtained by carrying out heat treatment at a higher temperature for a longer time at the stage of extraction and making the pH higher during the production than the conventional gelatin having setting properties. As a result of such treatment, even though the gelatin is a high-molecular weight material, its ability to form a gel becomes lower and the sol-gel reversibility is no longer exhibited even at room temperature.

Besides the alkali-process gelatin produced through the above treatment, the alkali-process gelatin used in the present invention may also include phthalated gelatin, acylated gelatin, phenylcarbamylated gelatin, acetylated gelatin, succinic-modified gelatin, and carboxyl-modified gelatin which are obtained by chemically modifying the alkali-process gelatin produced through the above treatment.

As a result of extensive studies made by the present inventors, it has also been found that the above alkali-process gelatin has good compatibility with the pigment described later. Alkali-process gelatins having physical properties such as molecular weight within specific ranges as shown below are particularly preferred as those which can form good ink-receiving layers suited for ink-jet recording.

1) Viscosity ratio of aqueous gelatin solution:

Its viscosity ratio at temperatures of 15° C. and 30° C. in an aqueous 2% gelatin solution which can be measured using a Brookfield type viscometer and is represented by the following expression, and may preferably be 10 or less.

$$\text{Viscosity ratio of aqueous gelatin solution} = (\text{viscosity at } 15^\circ\text{ C.})/(\text{viscosity at } 30^\circ\text{ C.})$$

If the ratio exceeds this range, the pigment/alkali-process gelatin aqueous dispersion tends to coagulate into a gel at room temperature to often make it necessary to apply heat during dispersion and coating.

As a more preferable range, the viscosity ratio may be 8 or less. If it is outside this range, the viscosity of the aqueous dispersion tends to change depending on temperatures and affects coating stability.

2) Weight average molecular weight:

Its weight average molecular weight (Mw), which can be determined by liquid chromatography, may preferably be from 50,000 to 150,000. If it exceeds the upper limit of this range, the pigment/alkali-process gelatin aqueous dispersion may have a high viscosity and tend to coagulate into a gel at room temperature to make it difficult to carry out dispersion and coating. If it is less than the lower limit of this range, the aqueous dispersion may have low film forming properties to cause the problem that cracks tend to occur before printing or after printing. As a more preferable range, the weight average molecular weight (Mw) may range from 70,000 to 120,000, within which range the aqueous dispersion can have good stability over time, ink absorptivity and so forth.

The ratio of weight average molecular weight after dispersion treatment (Mw2) to weight average molecular weight before dispersion treatment (Mw1), Mw2/Mw1, may preferably be from 0.5 to 1. If it exceeds the upper limit of this range, the aqueous dispersion tends to coagulate into a gel after dispersion to make it difficult to carry out uniform dispersion. If it is less than the lower limit of this range, the gelatin becomes low-molecular weight to have low film forming properties to tend to cause cracks before printing or after printing. As a more preferable range, the ratio may range from 0.7 to 1, within which range the aqueous dispersion can have good stability over time or storage stability. The dispersion treatment made here refers to dispersion treatment carried out by means of a dispersion machine as exemplified by a homomixer.

3) Jelly strength:

Its jelly strength, which can be measured using a jelly tester, may preferably be 200 g or less. If it exceeds this range, the pigment/alkali-process gelatin aqueous dispersion may have a very high viscosity to tend to coagulate into a gel at room temperature to make it necessary to apply heat during dispersion or coating, where precipitation of insoluble matter may be seen. It may preferably be 150 g or less, within which range the aqueous dispersion can have good stability over time.

4) Electrical conductivity:

Its electrical conductivity, which can be measured using a conductivity meter, may preferably be 200 $\mu$S/cm or less. If it exceeds this range, cationic species such as Ca ions and Mg ions and anionic species such as sulfate ions and halide ions become present in excess though the reason therefor is unclear, so that the viscosity abruptly increases to tend to cause gelation or precipitation of insoluble matter. Hence, it may become impossible to achieve a constant viscosity, and it becomes difficult to stably form good ink-receiving layers because of changes in physical properties such as thickness, pore diameter and pore volume of the ink-receiving layer obtained by coating and drying. The electrical conductivity may more preferably be in the range of 180 $\mu$S/cm or less, within which range recording mediums having a high gloss can be obtained.

Herein, the values of the above physical properties 2) to 4) are those measured by the method as prescribed in the PAGI method (the photographic gelatin test method established in 1992). Details relating to the measurement of these physical properties will be described in Examples given later.

The above alkali-process gelatin used in the present invention is obtained under adjustment of heat treatment conditions and pH at during its production. Even though it has a relatively high-molecular weight, its exhibits no gel forming ability at room temperature, provides an aqueous dispersion that can retain a stable sol state and at the same time shows superior properties in thixotropic properties and film forming properties. Also, this alkali-process gelatin undergoes hydrolysis and thus becomes low-molecular weight only with difficulty, and the aqueous dispersion can have superior stability over time or storage stability.

The specific alkali-process gelatin as described above may be used alone or may be used in the form of a mixture of two or more kinds. Further, the specific alkali-process gelatin may be used together with an acid process gelatin.

Gelatin with a weight average molecular weight less than 50,000 or a water-soluble polymeric material of various types may also be used in combination, in view of viscosity modification, improvement in adhesion, improvement in film strength and so forth. It may be used in an amount controlled within the range that may cause no difficulty in the forming of good ink-receiving layers, which varies depending on conditions such as the types of materials used and can not be absolutely stated. Stated approximately, it may be in an amount of about 3% to about 35% of the total weight of the binder.

The above water-soluble polymeric material that can be used in combination may specifically include, for example, natural polymeric materials and derivatives thereof such as starch, oxidized starch, acetate starch, amine starch, carboxyl starch, dialdehyde starch, cationic starch, dextrin, casein, pullulan, dextran, methyl cellulose, ethyl cellulose, propyl cellulose, ethyl methyl cellulose, carboxymethyl cellulose, hydroxyethyl cellulose, hydroxypropyl cellulose, gum arabic, tragacanth gum, karaya gum, echo gum, roast bean gum, albumin, chitin and saccharides; vinyl polymers or derivatives thereof such as polyvinyl alcohol, cation-modified polyvinyl alcohol, anion-modified polyvinyl alcohol, silanol-modified polyvinyl alcohol, polyvinyl pyrrolidone, polyvinyl pyridinium, polyvinyl imidazole and polyvinyl pyrazole; acrylic group-containing polymers such as polyacrylamide, polydimethyl aminoacrylate, polyacrylic acid or salts thereof, an acrylic acid-methacrylic acid copolymer or salts thereof, polymethacrylic acid or salts thereof, and an acrylic acid-vinyl alcohol copolymer or salts thereof; latexes such as SBR latex, NBR latex, a methyl methacrylate-butadiene copolymer and an ethylene-vinyl acetate copolymer; polyethylene glycol, polypropylene glycol, polyethyleneimine, maleic anhydride or copolymers thereof. Any one or more of these may be used in combination with the alkali-process gelatin.

The pigment and the alkali-process gelatin may be mixed in a weight ratio of from 3:1 to 30:1, within the range of which any desired ratio may be selected. If the alkali-process gelatin is in an amount less than the above range, the mechanical strength of the ink-receiving layer may decrease and tend to cause cracking or dusting. If it is in an amount more than the above range, the pore volume may become small to cause a lowering of ink absorptivity. They may preferably be in a weight ratio of from 5:1 to 25:1, within the range of which the aqueous dispersion can have good stability over time and also thick ink-receiving layers can be stably formed with ease.

The alkali-process gelatin used in the present invention can be hardened with a hardening agent. When hardened, the ink-receiving layer can be improved in water resistance.

Examples of the hardening agent include aldehyde compounds such as formaldehyde, glyoxal and glutaric aldehyde; ketone compounds such as diacetyl and cyclopentadione; activated halogen compounds such as bis(2-chloroethylurea)-2-hydroxy-4,6-dichloro-1,3,5-triazine, and 2,4-dichloro-6-S-triazine sodium salt; activated vinyl compounds such as divinyl sulfonic acid, 1,3-vinylsulfonyl-2-propanol, N,N'-ethylenebis(vinylsulfonylacetamide) and 1,3,5-triacryloyl-hexahydro-S-triazine; N-methylol compounds such as dimethylol urea and methyloldiemethylhydantoine; isocyanate compounds such as 1,6-hexamethylenediisocyanate; aziridine compounds disclosed in U.S. Pat. No. 3,017,280 and No. 2,983,611; carboxyimide compounds disclosed in U.S. Pat. No. 3,100,704; epoxy compounds such as glycerol triglycidyl ether; ethyleneimino compounds such as 1,6-hexamethylene-N,N'-bisethyleneurea; halogen carboxyaldehyde compounds such as mucochloric acid and mucophenoxychloric acid; dioxane compounds such as 2,3-dihydroxydioxane; and inorganic hardening agents such as chrome alum, potash alum, zirconium sulfate and chromium sulfate. Any of these may be used alone or in combination of two or more kinds.

The amount of the hardening agent used is appropriately determined taking into account the balance between water resistance of the ink-receiving layer and swellability of the alkali-process gelatin, and may range from 0.2 to 20 parts by weight, and preferably from 0.5 to 15 parts by weight, based on the amount of the alkali-process gelatin used.

In the present invention, the pigment, which substantially serves as the source of supporting particles of water-soluble dyes, can be exemplified by inorganic pigments such as calcium carbonate, kaolin, talc, calcium sulfate, barium sulfate, titania, zinc oxide, zinc carbonate, aluminum silicate, alumina hydrate, magnesium silicate, calcium silicate and silica, and organic pigments such as plastic pigments and urea resin pigments, any of which may be used and also may be used in combination.

Pigments particularly preferable from the viewpoint of ink absorptivity and image suitability such as resolution, include alumina hydrate, silica and calcium carbonate.

The alumina hydrate used in the present invention includes what is called aluminum hydroxide and is represented by the following Formula (I):

$$Al_2O_{3-n}(OH)_{2n}\cdot mH_2O$$

In the formula, n represents any of integers 0 to 3, m represents a value of 0 to 10, and preferably 0 to 5. The group $mH_2O$ represents in many cases an eliminable aqueous phase that does not participate in the formation of crystal lattices, and hence m may take a value which is not an integer. Upon calcination of alumina hydrates of this type, m can reach the value of 0.

The silica may include natural silica, synthetic silica, amorphous silica, and chemically modified silica compounds, any of which may be used without any particular limitations.

The calcium carbonate may include heavy calcium carbonate, light calcium carbonate and colloidal calcium carbonate, any of which may be used.

There are no particular limitations on these pigments used in the present invention. From the viewpoint of ink absorptivity, dispersibility and so forth, pigments having a pore volume of 0.1 g/ml or larger and having a fine particle diameter of from about hundreds nm to tens pm are particularly preferred.

In particular, the alumina hydrate has positive charges and hence it makes ink dyes fix well and can provide images with a high gloss, high image density and good color. Thus, this is more preferable as the pigment used in the ink-receiving layer. In particular, those disclosed in Japanese Patent Applications No. 5-125437, No. 5-125438, No. 5-125439 and No. 6-114571 are most preferable as alumina hydrates used in the present invention.

The ink-receiving layer is formed by coating on the base material (support) the aqueous dispersion containing the pigment and the binder such as gelatin by means of a coater, followed by drying. The coating may be carried out by a process such as blade coating, air-knife coating, roll coating, brush coating, gravure coating, kiss coating, extrusion coating, slide hopper (slide bead) coating, curtain coating or spray coating, without any particular limitations.

The aqueous dispersion may be coated in an amount ranging from 0.5 to 60 g/m$^2$, and preferably from 5 to 45 g/m$^2$. In order to obtain good ink absorptivity and resolution, it is preferable to coat it to form the ink-receiving layer in a thickness of 15 $\mu$m or more, and preferably 20 $\mu$m or more.

Since the aqueous dispersion used to carry out the coating described above enables dispersion and coating in an environment of room temperature, it exhibits no gel forming ability at room temperature and shows a stable sol state. Hence, in the pigment/alkali-process gelatin aqueous dispersion of the present invention, when its total solid matter is in a concentration of 20% and the solid matter of the alkali-process gelatin is in a concentration of 2%, the viscosity ratio of the aqueous dispersion at temperatures 15° C. and 30° C. (viscosity at 15° C./viscosity at 30° C.) may preferably be 2 or less and its viscosity ratio at temperatures 15° C. and 20° C. (viscosity at 15° C./viscosity at 20° C.) may preferably be 1.5 or less.

If the viscosity ratios are outside these ranges, the aqueous dispersion tends to coagulate into a gel at room temperature to make it necessary to apply heat during dispersion and coating, causing problems on equipment and productivity; when the coating solution is dried at a high temperature, it turns low-viscosity before it is completely dried and tends to cause sagging, and it becomes necessary to carry out drying at a low temperature to obtain a thick ink-receiving layer, resulting in a decrease in productivity.

More preferably, the viscosity ratio of the aqueous dispersion at temperatures 15° C. and 30° C. may be 1.5 or less and its viscosity ratio at temperatures 15° C. and 20° C. may be 1.3 or less. If the ratios are outside these ranges, the viscosity of the aqueous dispersion may greatly change depending on temperature, and hence it may become difficult to control temperatures at the time of coating, tending to affect the stability of coating.

In the aqueous dispersion of the present invention, the ratio of its viscosity after storage for 7 days at rest and its viscosity at the initial stage immediately after dispersion (viscosity with time/initial viscosity) may range from 0.5 to 3, which is a preferable range. If the ratio is outside this range, the aqueous dispersion may have a short pot life and tends to cause problems in the coating stability or storage stability of the aqueous dispersion. As a more preferable range, the ratio may range from 0.5 to 2.5, within which range the aqueous dispersion can be defoamed with ease to bring about an improvement in productivity and at the same time make it possible to prevent coat defects.

The alkali-process gelatin used in the present invention, as also previously stated, can make the aqueous dispersion have good stability over time or storage stability, and can maintain a stable state of dispersion over a long period of time.

The aqueous dispersion used to carry out the coating described above exhibits thixotropy; the reason therefor is unclear. In the present invention, a TI value is used as an indication of the degree of thixotropic properties. The TI (thixotropic index) value is a value obtained by measuring viscosity using a rotational viscometer such as a Brookfield type viscometer while changing the number of revolutions, and dividing a numerical value at the time of low-speed revolution by a numerical value at the time of high-speed revolution. In the present invention, the value is calculated as a numerical value of 6 rpm/60 rpm. When this value is greater than 1, it follows that the liquid forms a structure and exhibits thixotropy.

In the aqueous dispersion of the present invention, the TI value may vary depending on the solid matter concentration, conditions for dispersion and so forth, and may preferably be within the range of from 1.1 to 5.0, and more preferably within the range of from 1.3 to 4.5. It is preferable to prepare the aqueous dispersion to have the TI value within such a range.

Because of use of the specific alkali-process gelatin, the aqueous dispersion of the present invention exhibits no gel forming ability and displays thixotropy. Hence, when coated, the liquid can be applied on the support at a stable low viscosity and, after leveling, can be brought to the state where the liquid stands still (the state where no force is applied), so that its viscosity tends not to increase and cause sagging. Thus, a thick ink-receiving layer can be formed with ease.

If the TI value is outside the specific range, the aqueous dispersion may have low thixotropic properties, or no thixotropic properties, and the aqueous dispersion coated on the support may sag to tend to be affected by wind pressure in the step of drying, making it difficult to form a thick ink-receiving layer. If it is beyond this range, a dispersion machine that can apply a great force becomes necessary in order to decrease the viscosity, making it necessary to use an apparatus of great size. When the force is insufficient, the viscosity cannot decrease to cause difficulty in coating.

The alkali-process gelatin contained in the aqueous dispersion may preferably be in a solid matter concentration within the range of from 0.01 to 10%. If the solid matter concentration is less than this range, the aqueous dispersion may have such low thixotropic properties that it becomes difficult to form the ink-receiving layer in a good thickness. If the solid matter concentration is beyond the above range, the aqueous dispersion may have such a high viscosity that the aqueous dispersion tends to have low stability over time. As a particularly preferable range, it may range from 0.05 to 7%, within which range the recording medium can have good color performance of ink and good glossiness of the ink-receiving layer, and printed materials with a high quality level can be obtained.

To the pigment and the binder, it is possible to optionally add a pigment dispersant, a thickening agent, a pH adjuster, a lubricant, a fluidity modifying agent, a surface active agent, a defoaming agent, a water-resisting agent, a foam controlling agent, a release agent, a foaming agent, a penetrating agent, a coloring dye, a fluorescent brightener, an ultraviolet absorbent, an antioxidant, an antiseptic agent and an antifungal agent.

The water-resisting agent it may be arbitrarily selected from known materials such as halogenated quaternary ammonium salts and quaternary ammonium salt polymers.

As the support, papers such as appropriately sized paper, non-sized paper and resin-coated paper, sheetlike materials such as thermoplastic films, and cloths may be used, and there are no particular limitations.

In the case of thermoplastic films, it is possible to use transparent films such as polyester film, polystyrene film, polyvinyl chloride film, polymethyl methacrylate film, cellulose acetate film, polyethylene film and polycarbonate film, and also sheets made opaque by filling or fine-foaming with an alumina hydrate or titanium white.

When the resin-coated paper is used as the support, the same touch, stiffness and texture as those of usual photographic prints can be obtained. Also, since the recording medium of the present invention is provided with the ink-receiving layer having a high gloss, the resulting printed materials can be fairly similar to photographic prints.

In order to improve adhesion between the support and the ink-receiving layer, the support may be subjected to surface treatment such as corona treatment, or may be provided with a readily adherent layer as a subbing layer. In order to prevent curling, the support may be provided at its back or a given portion, with an anticurl layer such as a resin layer or a pigment layer.

Since the specific alkali-process gelatin described above is used, it is unnecessary to disperse the pigment/alkali-process gelatin aqueous dispersion under application of heat or to coat the aqueous dispersion under application of heat, which has been hitherto essential, and it has become possible to carry out usual room-temperature dispersion and room-temperature coating. Since also the present alkali-process gelatin has thixotropic properties at the same time, the sagging may hardly occur immediately after the coating and it is easy to form a thick ink-receiving layer. Moreover, this alkali-process gelatin has a high-molecular weight, and has good film forming properties and appearance suitability, such as gloss.

According to the present invention, it is possible to obtain a recording medium that has superior image density, ink absorptivity and color reproducibility and also has a superior ink absorption speed compared with where the conventional gelatin having setting properties is used. This is because the thixotropic properties and viscosity stability to temperature changes possessed by the aqueous dispersion make it unnecessary to cause the coating solution to gel and dry on the support, so that it becomes possible to carry out high temperature drying at 80° C. or above immediately after coating to thereby lower the water content in the ink-receiving layer. Especially in the present invention, the ink-receiving layer has a small water content of from 0.01 to 5%, and hence the sheet surface can be less tacky and is almost free from mutual adhesion between mediums or sticking to rollers during transportation. The cause thereof is presumed to be a decrease in swell of the ink-receiving layer on account of a mutual action with the pigment. This also can eliminate the problem of wrinkling due to swelling at high-density printed areas that tends to occur when gelatin is used. Also, the ink-receiving layer having a water content of from 0.01 to 5% is more preferable since it becomes easy to obtain printed images at a high resolution, having less feathering and also having good dot reproducibility. Moreover, this recording medium may hardly cause mixture between ink droplets on the ink-receiving layer and may hardly cause beading or bleeding, so that sharp images can be obtained. Here, the beading refers to a phenomenon of particle-shaped density unevenness due to aggregation of ink droplets that may occur at solid printed areas, and the bleeding refers to a phenomenon of blur due to color mixture of different kinds of ink droplets that may occur at color boundaries.

The ink used in the recording method of the present invention mainly contains a coloring material (dye or pigment), a water-soluble organic solvent and water. As the dye, for example, a water-soluble dye as typified by direct dyes, acid dyes, basic dyes, reactive dyes and food dyes are preferable. Any of these may be used so long as they can provide images satisfying fixing performance, color performance, sharpness, stability, light-fastness and other required performances, in combination with the recording medium.

The water-soluble dye is commonly dissolved in a solvent comprising water, or water and an organic solvent, when used. As these solvent components, a mixture of water and a water-soluble organic solvent of various types may preferably be used, and may preferably be so controlled that the water content in the ink is within the range of from 20 to 90% by weight, and preferably from 60 to 90% by weight.

The water-soluble organic solvent may include, for example, alkyl alcohols having 1 to 4 carbon atoms such as methyl alcohol, ethyl alcohol, n-propyl alcohol, isopropyl alcohol, n-butyl alcohol, sec-butyl alcohol, tert-butyl alcohol and isobutyl alcohol; amides such as dimethylformamide and dimethylacetamide; ketones or ketoalcohols such as acetone and diacetone alcohol; ethers such as tetrahydrofuran and dioxane; polyalkylene glycols such as polyethylene glycol and polypropylene glycol; alkylene glycols the alkylene group of which has 2 to 6 carbon atoms, such as ethylene glycol, propylene glycol, 1,2,6-hexanetriol, thiodiglycol, hexylene glycol and diethylene glycol; glycerol; lower alkyl ethers of polyhydric alcohols, such as ethylene glycol methyl ether, ethylene glycol ethyl ether, diethylene glycol methyl ether, diethylene glycol ethyl ether, triethylene glycol methyl ether and triethylene glycol ethyl ether.

Of these many water-soluble organic solvents, polyhydric alcohols such as ethylene glycol and diethylene glycol, and lower dialkyl ethers of polyhydric alcohols, such as triethylene glycol monomethyl ether and triethylene glycol monoethyl ether are preferred. The polyhydric alcohols are particularly preferred as being greatly effective as lubricants for preventing nozzles from clogging which is caused when the water in ink evaporates to cause deposition of the water-soluble dye.

A solubilizing agent may also be added to the ink. Typical solubilizing agents are nitrogen-containing heterocyclic ketones. The action intended by its addition is to dramatically improve dissolution of the water-soluble dye in the solvent. For example, N-methyl-2-pyrrolidone and 1,3-dimethyl-2-imidazolidinone are preferably used. For the purpose of improving properties, it is also possible to add additives such as a viscosity modifier, a surface active agent, a surface tension modifier, a pH adjuster, a resistivity modifier and a storage stabilizer.

An image forming method comprising imparting the above ink to the above recording medium to make a record may preferably be a method that carries out an ink-jet recording process. This recording process may be of any type so long as it is a process that can effectively cause the ink to leave from nozzles to impart the ink to the recording medium. In particular, the process disclosed in Japanese Patent Application Laid-open No. 54-59936 can be effectively used, which is an ink-jet recording system in which an ink having undergone the action of heat energy causes an abrupt change in volume and the ink is ejected from nozzles by the force of action attributable to this change in state.

EXAMPLES

The present invention will be described below in greater detail by giving Examples. The present invention is by no means limited to these.

Various physical properties of the gelatin according to the present invention [(A) to (C); available from Nippi Gelatin Industries, Ltd.] were measured according to the following procedure. Results obtained are shown in Table 1.

1) Viscosity ratio of aqueous gelatin solution:

While dropping the temperature of an aqueous 2% gelatin solution from 50° C. to 10° C. at a rate of 1° C./minute, its viscosities were measured using a Brookfield type viscometer (VISCOMETER, manufactured by Tokimec Co.) and a low-viscosity adapter, No. 2 rotor (rate of revolution: 30 rpm). The viscosity ratio at liquid temperatures 15° C. and 30° C. was determined according to the following expression.

Viscosity ratio of aqueous gelatin solution=(viscosity at 15° C.)/(viscosity at 30° C.)

2) Weight average molecular weight:

In a 100 ml measuring flask, 2.0 g of gelatin was taken, and an eluting solution (a 1:1 mixture of 0.1 M potassium dihydrogenphosphate and 0.1 M disodium hydrogenphosphate) was added thereto to sufficiently swell the gelatin, followed by dissolution at about 40° C. over a period of about 6 hours to obtain a solution serving as a base liquid. This base liquid was diluted to 1/10 with an eluting solution to obtain a 0.2% test solution, which was then filtered with a membrane filter of 0.45 μm. Thereafter, the weight average molecular weight was measured by high-speed liquid chromatography. Molecular weight distribution after dispersion treatment was also measured in the following way: The base liquid was stirred at 8,000 rpm for 30 minutes by means of a dispersion machine (T.K. Homomixer Model M, manufactured by Tokushu Kika Kogyo K.K.), and thereafter similarly diluted with an eluting solution and filtered. Thereafter the molecular weight distribution was measured by high-speed liquid chromatography.

The device used and the measurement conditions were as follows:

(Device; manufactured by Toso Co.)

Main body: HCL-8020

System controller: SC-8010

Spectrophotometer: UV-8010

Autosampler: AS-8000

Degasser: SD-8000

Printer: PP-8010

(Conditions)

Column: GPC columns comprised of a vinyl alcohol copolymer (ASAHIPAK GS-620, available from Asahi Chemical Industry Co., Ltd.; two columns connected in series)

Flow rate: 1.0 ml/minute

Amount of injection: 100 μl

Manner of detection: Optical density at 230 nm in the ultraviolet region

To calculate molecular weight, the following method was employed. A calibration curve is prepared from retention time and molecular weight, using albumin, ovalbumin, mitochrome or the like whose molecular weight is previously known, under the conditions shown above, and the retention time of the test gelatin solution is applied to the calibration curve to calculate the molecular weight.

This method is described in "The Relationship between Molecular Weight Distribution and Viscosity of Gelatin and Jelly Strength" made known to the public in the March Regular Meeting held by The Photographic Society of Japan on Mar. 9, 1984. The ratio of weight average molecular weight after dispersion treatment (Mw2) to weight average molecular weight before dispersion treatment (Mw1), Mw2/Mw1, was also measured.

3) Jelly strength:

6 and 2/3% gelatin was cooled to 10° C. in a special jelly cup made of glass, and the load required to press down the surface of the gelatin by 4 mm using a special plunger was measured by means of a jelly tester (manufactured by Stevens Co.).

4) Electrical conductivity:

Electrical conductivity of an aqueous 2% gelatin solution was measured at liquid temperature of 25° C., using a conductivity meter (CM-60S; manufactured by Toa Denpa Kogyo K.K.).

TABLE 1

| Sample: | (A) | (B) | (C) |
|---|---|---|---|
| Weight average molecular weight (Mw1): | 55,000 | 88,000 | 96,000 |
| Aqueous gelatin solution viscosity ratio (15° C./30° C.): | 1.2 | 1.5 | 1.8 |
| Jelly strength: (g) | 30 | 66 | 101 |
| Electrical conductivity: (μs/cm) | 80 | 120 | 30 |
| Weight average molecular weight after dispersion (Mw2): | 54,000 | 80,000 | 95,000 |
| Weight average molecular weight ratio (Mw2)/(Mw1): | 0.98 | 0.91 | 0.99 |

Examples 1 to 5

To a 2.5% by weight solution prepared by dissolving and dispersing the alkali-process gelatins (A) to (C) each in ion-exchanged water at room temperature (25° C.), alumina hydrate (Example 1 described in Japanese Patent Application No. 6-114671; herein "a"), silica (MIZUKASIL P-87, available from Mizusawa Industrial Chemicals, Ltd.; herein "s") and calcium carbonate (CALLITE SA, available from Shiraishi Kogyo Kaisha, Ltd.; herein "c") were added, which were then dispersed at 8,000 rpm for 30 minutes by means of a dispersion machine (T.K. Homomixer Model M, manufactured by Tokushu Kika Kogyo K.K.) to obtain a 20% by weight mixed aqueous dispersion. The ratio of pigment to alkali-process gelatin at these aqueous dispersions were 8.8:1.

The aqueous dispersions thus obtained were each coated on a white polyester film (LUMIROR X-21, available from Toray Industries, Inc., thickness: 100 μm) by bar coating at room temperature (25° C.), followed by drying at 100° C. to obtain recording mediums each having an ink-receiving layer of 30 μm thick. The physical properties of the respective aqueous dispersions and the ink-receiving layers were measured by the methods as described later. Results obtained are shown in Table 2.

Evaluation and Measurement of Physical Properties of Aqueous Dispersions

1) State of dispersion

Evaluated by visual judgement. An instance where no gelation occurred and no insoluble matter was produced was evaluated as "A"; and an instance where gelation occurred and insoluble matter was produced, resulting in poor dispersion, as "C".

2) TI value

Using the Brookfield type viscometer in the manner previously described, the value was calculated according to the following expression;

$$\text{TI value}=(\text{viscosity at 6 rpm})/(\text{viscosity at 60 rpm})$$

as values determined under conditions of rotor: No. 1, and measurement temperature: 25° C.

3) Viscosity ratio of aqueous dispersion

While dropping the temperature of the aqueous dispersion from 50° C. to 10° C. at a rate of 1° C./minute, its viscosities were measured using the Brookfield type viscometer and a low-viscosity adapter, No. 3 rotor (number of revolution: 30 rpm).

The viscosity ratio at liquid temperatures 15° C. and 30° C. and viscosity ratio at liquid temperatures 15° C. and 20° C. were determined according to the following expression.

$$\text{Viscosity ratio 1 of aqueous dispersion}=(\text{viscosity at 15° C.})/(\text{viscosity at 30° C.})$$

$$\text{Viscosity ratio 2 of aqueous dispersion}=(\text{viscosity at 15° C.})/(\text{viscosity at 20° C.})$$

4) Stability with time

Viscosity at the initial stage immediately after preparation of aqueous dispersions and viscosity after storage in a closed vessel at 25° C. for 7 days at rest were measured using the Brookfield type viscometer to determine the value of (viscosity with time/initial viscosity); as values measured under conditions of rotor: No. 1; number of revolution: 30 rpm; and measurement temperature: 25° C.

Evaluation and Measurement of Physical Properties of Recording Medium

1) State of coating of ink-receiving layer

Evaluated by visual judgement. An instance where a smooth surface was obtained and it was in a good state was evaluated as "A"; and an instance where the surface was rough or had cracked or defects caused by, e.g., adhesion of insoluble matter, as "C".

2) Water content of ink-receiving layer

The support (white polyester film) and the recording medium were respectively cut out into test strips of 10 cm square, which were then left to stand in an environment of temperature 23° C. and humidity 60% for 24 hours, and weight of support (W1) and weight of recording medium (W2) were measured. These were further left to stand for 2 hours in a 105° C. thermostatic dryer, and thereafter dry weight of support (W1') and dry weight of recording medium (W2') were measured. Then the water content of the ink-receiving layer was determined according to the following expression.

$$\text{Water content (\%)}=\frac{(W2-W1)-(W2'-W1')}{W2-W1}\times 100$$

3) Adhesion of recording medium

Ten sheets of A4-size recording mediums were piled up, and a 5 mm thick, like-size glass plate was put thereon, on which a 20 kg weight was further put, which were then left to stand in an environment of temperature 23° C. and humidity 60% for 2 hours. An instance where sheets stuck to one another after standing was evaluated as "C"; and an instance where they did not stuck, as "A".

4) Print characteristics

Using an ink-jet printer having ink-jet heads corresponding to four colors, Y (yellow), M (magenta), C (cyan) and Bk (black), provided with 128 nozzles at nozzle intervals of 16 nozzles per 1 mm, ink-jet recording was carried out using inks having the composition shown below, and evaluation was made on surface state of printed areas, ink drying performance (ink absorptivity), image density, feathering, beading, bleeding, glossiness and color reproducibility.

(a) Surface state of printed areas

The surface state of each recording medium was evaluated by visual judgment after images were printed thereon in ink quantities of Bk 100%+Y 50%+C 50%+M 50% using the inks shown below. An instance where smooth surface was maintained in a good state was evaluated as "A"; and an instance where cracking or wrinkling occurred to make the surface rough, as "C".

(b) Ink absorptivity

Solid images were printed in monochromes or multicolors using the Y, M, C and Bk inks shown below, and immediately thereafter the recorded areas were touched with the fingers to examine how the inks dried on the surface of the recording medium. The ink quantity in the monochrome printing was regarded as 100%.

An instance where no ink adheres to the fingers in an ink quantity of 300% was evaluated as "AA"; an instance where no ink adheres to the fingers in an ink quantity of 200%, as "A"; and an instance where no ink adheres to the fingers in an ink quantity of 100%, as "B".

(c) Image density

Solid images were printed using the magenta ink shown below to evaluate their image density by the use of Macbeth Reflection Densitometer RD-918. The magenta image density was lowest among the four colors in all Examples.

(d) Resolution (feathering)

Solid images were printed in monochromes or multicolors using the Y, M, C and Bk inks shown below, and thereafter any feathering on the surfaces of the recording medium was visually judged to make evaluation. The ink quantity in the monochrome printing was regarded as 100%.

An instance where no feathering occurred in an ink quantity of 300% was evaluated as "AA"; an instance where no feathering occurred in an ink quantity of 200%, as "A"; and an instance where no feathering occurred in an ink quantity of 100%, as "B".

(e) Beading

Solid images were printed in monochromes or multicolors using the Y, M, C and Bk inks shown below, and thereafter any particle-shaped density unevenness at printed areas was visually judged to make an evaluation.

An instance where no beading occurred in an ink quantity of 300% was evaluated as "AA"; an instance where no beading occurred in an ink quantity of 200%, as "A"; and an instance where no beading occurred in an ink quantity of 100%, as "B".

(f) Bleeding

Solid images were printed in monochromes or multicolors using the Y, M, C and Bk inks shown below, and thereafter any blur due to color mixture at color boundaries was visually judged to make an evaluation.

An instance where no bleeding occurred in an ink quantity of 300% was evaluated as "AA"; an instance where no bleeding occurred in an ink quantity of 200%, as "A"; and an instance where no bleeding occurred in an ink quantity of 100%, as "B".

(g) Glossiness

This was determined using a gloss meter (Gloss Checker IG-320, manufactured by K.K. Horiba Seisakusho), by measuring white background (non-printed areas) and black (printed areas of Bk 100%+C 50%+M 50%+Y 50%).

(h) Color reproducibility

Maximum absorption wavelength $\lambda 1$ of the cyan ink shown below and maximum absorption wavelength $\lambda 2$ of printed areas of the recording medium on which images were printed using the cyan ink were measured by a spectrophotometer (Hitachi Autographic Spectrophotometer U-3410, manufactured by Hitachi Ltd.) to determine an absolute value of the amount of change ($\Delta\lambda C$) of maximum absorption wavelength of each color.

| Ink composition: | |
|---|---|
| Dyes* | 5 parts |
| Ethylene glycol | 10 parts |
| Polyethylene glycol | 10 parts |
| Water | 75 parts |

*Dyes:
Y: C.I. Direct Yellow 86
M: C.I. Acid Red 35
C: C.I. Direct Blue 199
Bk: C.I. Food Black 2

TABLE 2

| Example: | 1 | 2 | 3 | 4 | 5 |
|---|---|---|---|---|---|
| Gelatin: | (A) | (B) | (C) | (C) | (C) |
| Pigment: | a | a | a | s | c |
| State of dispersion: | AA | AA | AA | AA | AA |
| TI value: | 2.3 | 2.5 | 3.1 | 2.3 | 2.1 |
| Aqueous dispersion viscosity ratio 1 (15° C./30° C.): | 1.1 | 1.3 | 1.3 | 1.2 | 1.2 |
| Aqueous dispersion viscosity ratio 2 (15° C./20° C.): | 1.0 | 1.1 | 1.1 | 1.0 | 1.0 |
| State of coating: | A | A | A | A | A |
| Water content (%): | 2.5 | 2.6 | 2.4 | 3.0 | 2.8 |
| Adhesion: | A | A | A | A | A |
| Surface state of printed area: | A | A | A | A | A |
| Ink absorptivity: | AA | AA | AA | AA | AA |
| Image density: | 1.82 | 1.83 | 1.85 | 1.75 | 1.72 |
| Resolution: | AA | AA | AA | AA | AA |
| Beading: | AA | AA | AA | AA | AA |
| Bleeding: | AA | AA | AA | AA | AA |
| (Viscosity with time/Initial viscosity): | 1.2 | 1.3 | 1.5 | 1.4 | 1.3 |
| Glossiness (white background): | 62.5 | 63.0 | 65.0 | 60.2 | 58.0 |
| Glossiness (black): | 65.3 | 67.5 | 67.8 | 58.0 | 58.5 |
| $\Delta\lambda C$: (nm) | 5 | 6 | 5 | 8 | 7 |

As described above, since a specific alkali-process gelatin that has a high-molecular weight and has no sol-gel reversibility (setting properties) at room temperature is used as a binder, superior features in ink absorptivity, resolution, color reproducibility, image density and so forth can be attained. Also, since this alkali-process gelatin has high dispersibility and thixotropic properties together with film forming properties, it can stably form a thick ink-receiving layer. Hence, a recording medium having sufficient ink absorptivity and image (print) suitability, such as resolution, and satisfactory appearance, such as high glossiness, can be obtained.

The present invention has also made it possible to prepare and coat the aqueous dispersion at room temperature, which has been hitherto difficult when a gelatin having setting properties is used, and at the same time has brought about improvements in the productivity of aqueous dispersions and in stability to changes with time, or storage stability. Moreover, the recording medium produced using this gelatin, compared with those produced using the conventional gelatin having setting properties, can be dried at a high temperature, and hence has a lower water content after drying, has a superior ink absorption speed and can form sharp images with less feathering, beading and bleeding.

What is claimed is:

1. A recording medium comprising an ink-receiving layer comprising a pigment and, as a binder, an alkali-process gelatin, wherein said alkali-process gelatin has no sol-gel reversibility in an environment of room temperature and has a weight average molecular weight within the range of from 50,000 to 150,000.

2. The recording medium according to claim 1, wherein said gelatin has a weight average molecular weight within the range of from 70,000 to 120,000.

3. The recording medium according to claim 1, wherein said pigment is selected from the group consisting of alumina hydrate, silica and calcium carbonate.

4. The recording medium according to claim 1, wherein said gelatin has an electrical conductivity of 200 $\mu$S/cm or less.

5. The recording medium according to claim 1, wherein said gelatin has an electrical conductivity of 180 $\mu$S/cm or less.

6. The recording medium according to claim 1, wherein said gelatin has a jelly strength of 200 g or less.

7. The recording medium according to claim 1, wherein said gelatin has a jelly strength of 150 g or less.

8. The recording medium according to claim 1, wherein said pigment and said alkali-process gelatin are contained in a weight ratio ranging from 3:1 to 30:1.

9. The recording medium according to claim 1, wherein said pigment and said alkali-process gelatin are contained in a weight ratio ranging from 5:1 to 25:1.

10. The recording medium according to claim 1, wherein said ink-receiving layer has a water content within the range of from 0.01 to 5%.

11. The recording medium according to claim 1, wherein said ink-receiving layer has a water content within the range of from 0.1 to 3.5%.

12. The recording medium according to claim 1, wherein the ink-receiving layer has a thickness of 15 $\mu$m or more.

13. The recording medium according to claim 12, wherein the ink-receiving layer has a thickness of 20 $\mu$m or more.

14. A recording medium comprising an ink receiving layer comprising an alumina hydrate and, as a binder, an alkali-process gelatin, wherein said alkali-process gelatin has no sol-gel reversibility in an environment of room temperature and has a weight average molecular weight within the range of from 50,000 to 150,000.

15. The recording medium according to claim 14, wherein the alumina hydrate is represented by the following formula:

$$Al_2O_{3-n}(OH)_{2n}\cdot mH_2O$$

wherein n is an integer of 0 to 3, m is a number of 0 to 10, and n and m are not both zero.

16. The recording medium according to claim 14, wherein said gelatin has a weight average molecular weight within the range of from 70,000 to 120,000.

17. The recording medium according to claim 14, wherein said gelatin has an electrical conductivity of 200 $\mu$S/cm or less.

18. The recording medium according to claim 14, wherein said gelatin has an electrical conductivity of 180 $\mu$S/cm or less.

19. The recording medium according to claim 14, wherein said gelatin has a jelly strength of 200 g or less.

20. The recording medium according to claim 14, wherein said gelatin has a jelly strength of 150 g or less.

21. The recording medium according to claim 14, wherein said pigment and said alkali-process gelatin are contained in a weight ratio ranging from 3:1 to 30:1.

22. The recording medium according to claim 14, wherein said pigment and said alkali-process gelatin are contained in a weight ratio ranging from 5:1 to 25:1.

23. The recording medium according to claim 14, wherein said ink-receiving layer has a water content within the range of from 0.01 to 5%.

24. The recording medium according to claim 14, wherein said ink-receiving layer has a water content within the range of from 0.1 to 3.5%.

25. The recording medium according to claim 14, wherein the ink-receiving layer has a thickness of 15 $\mu$m or more.

26. The recording medium according to claim 14, wherein the ink-receiving layer has a thickness of 20 $\mu$m or more.

27. A printed material comprising the recording medium according to any one of claims 1 to 26 and an image formed thereon.

* * * * *

UNITED STATES PATENT AND TRADEMARK OFFICE

CERTIFICATE OF CORRECTION

PATENT NO. : 5,804,320

DATED : September 8, 1998

INVENTOR(S) : HIROSHI TOMIOKA, ET AL.

It is certified that error appears in the above-identified patent and that said Letters Patent is hereby corrected as shown below:

COLUMN 5:

Line 59, "at during" should read --during--.

COLUMN 7:

Line 27, "suitability" should read --suitability,--.

COLUMN 9:

Line 49, "agent it" should read --agent--.

COLUMN 12:

Line 50, "like" should read --like,--.

COLUMN 14:

Line 49, "stuck," should read --stick,--.

UNITED STATES PATENT AND TRADEMARK OFFICE

CERTIFICATE OF CORRECTION

PATENT NO. : 5,804,320

DATED : September 8, 1998

INVENTOR(S) : HIROSHI TOMIOKA, ET AL.

It is certified that error appears in the above-identified patent and that said Letters Patent is hereby corrected as shown below:

COLUMN 18:

Line 34, "claim 14," should read --claim 25,--.

Signed and Sealed this

Fourteenth Day of December, 1999

*Attest:*

Q. TODD DICKINSON

*Attesting Officer*

*Acting Commissioner of Patents and Trademarks*